US011101596B1

(12) United States Patent
Lin

(10) Patent No.: US 11,101,596 B1
(45) Date of Patent: Aug. 24, 2021

(54) WATERPROOF ENHANCED RF CONNECTOR

(71) Applicant: GRAND-TEK TECHNOLOGY CO., LTD., New Taipei (TW)

(72) Inventor: Yu-Wei Lin, New Taipei (TW)

(73) Assignee: GRAND-TEK TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/988,751

(22) Filed: Aug. 10, 2020

(51) Int. Cl.
*H01R 13/52* (2006.01)
*H01R 13/506* (2006.01)

(52) U.S. Cl.
CPC ..... *H01R 13/521* (2013.01); *H01R 13/506* (2013.01); *H01R 13/5202* (2013.01)

(58) Field of Classification Search
CPC . H01R 13/5202; H01R 13/521; H01R 13/506
See application file for complete search history.

(56) References Cited

U.S. PATENT DOCUMENTS 8,870,602 B2 * 10/2014 Cook ..... H01R 27/02 439/660
9,450,346 B1 * 9/2016 Garcia ..... H01R 12/728

* cited by examiner

*Primary Examiner* — Briggitte R. Hammond
(74) *Attorney, Agent, or Firm* — Bacon & Thomas, PLLC

(57) ABSTRACT

A radio frequency connector includes an outer shell, a connector and a waterproof gasket. The outer shell is provided with partition walls opposite to each other and convex structures protruding toward the partition walls. The first side of the connector is provided with a plurality of plug terminals. The waterproof gasket is disposed surrounding all the plug terminals. When the connector is accommodated in the outer shell, the plug terminal is received corresponding to the through hole of the partition wall. The convex structures abut the second side opposite to the first side to push the connector toward the partition wall for reducing the distance between the first side and the partition wall. Thus, the waterproof gasket can be tightly sandwiched between the first side and the partition wall to enhance the waterproof effect.

8 Claims, 5 Drawing Sheets

WATERPROOF ENHANCED RF CONNECTOR

BACKGROUND OF THE INVENTION

Field of the Invention

The present invention generally relates to a radio frequency (RF) connector, and more particular, to a waterproof enhanced radio frequency connector.

Description of Related Art

Regarding RF connectors, in order to provide a variety of signal connections, such as Wi-Fi, Wi-Fi 6, 3G, 4G, and 5G, etc., they must have a plurality of plug terminals.

The waterproof design of existing RF connectors is to dispose a waterproof gasket for each plug terminal separately. Therefore, it is troublesome and inconvenient to assemble the waterproof gasket, and it takes time and labor. However, if only one large waterproof gasket is disposed to surround all the plug terminals, the compression and tightness of the waterproof gasket are insufficient, which lead to an insufficient waterproof effect.

SUMMARY OF THE INVENTION

Accordingly, an object of the present invention is to provide a waterproof enhanced RF connector, in which the convex structures are provided for pushing the connector to enhance the tightness of the waterproof gasket being clamped.

In order to achieve the object mentioned above, the present invention provides a waterproof enhanced radio frequency connector comprising: an outer shell having a first position and a second position opposite to each other inside thereof; a partition wall provided at the first position and the partition wall having a plurality of through holes; and the second position having a plurality of convex structures protruding toward the partition wall; a connector having a first side and a second side opposite to each other, and the first side protruding with a plurality of plug terminals; and a waterproof gasket disposed surrounding the plug terminals; wherein, the connector is accommodated in the outer shell, and each of the plug terminals is received in each of the through holes; and the convex structures abut the second side, and the waterproof gasket is clamped and sandwiched between the first side and the partition wall by the convex structures pushing the connector toward the partition wall.

Comparing to the prior art, the present invention has the following effects. When the connector is accommodated in the outer shell, the convex structures abut the second side to push the connector toward the partition wall, so that the waterproof gasket can be tightly sandwiched between the first side and the partition wall to enhance the waterproof effect.

BRIEF DESCRIPTION OF DRAWINGS

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE PREFERRED EMBODIMENTS

In cooperation with attached drawings, the technical contents and detailed description of the invention are described thereinafter according to a number of preferable embodiments, not being used to limit its executing scope. Any equivalent variation or modification made according to appended claims is all covered by the claims claimed by the present invention.

Figure 1:
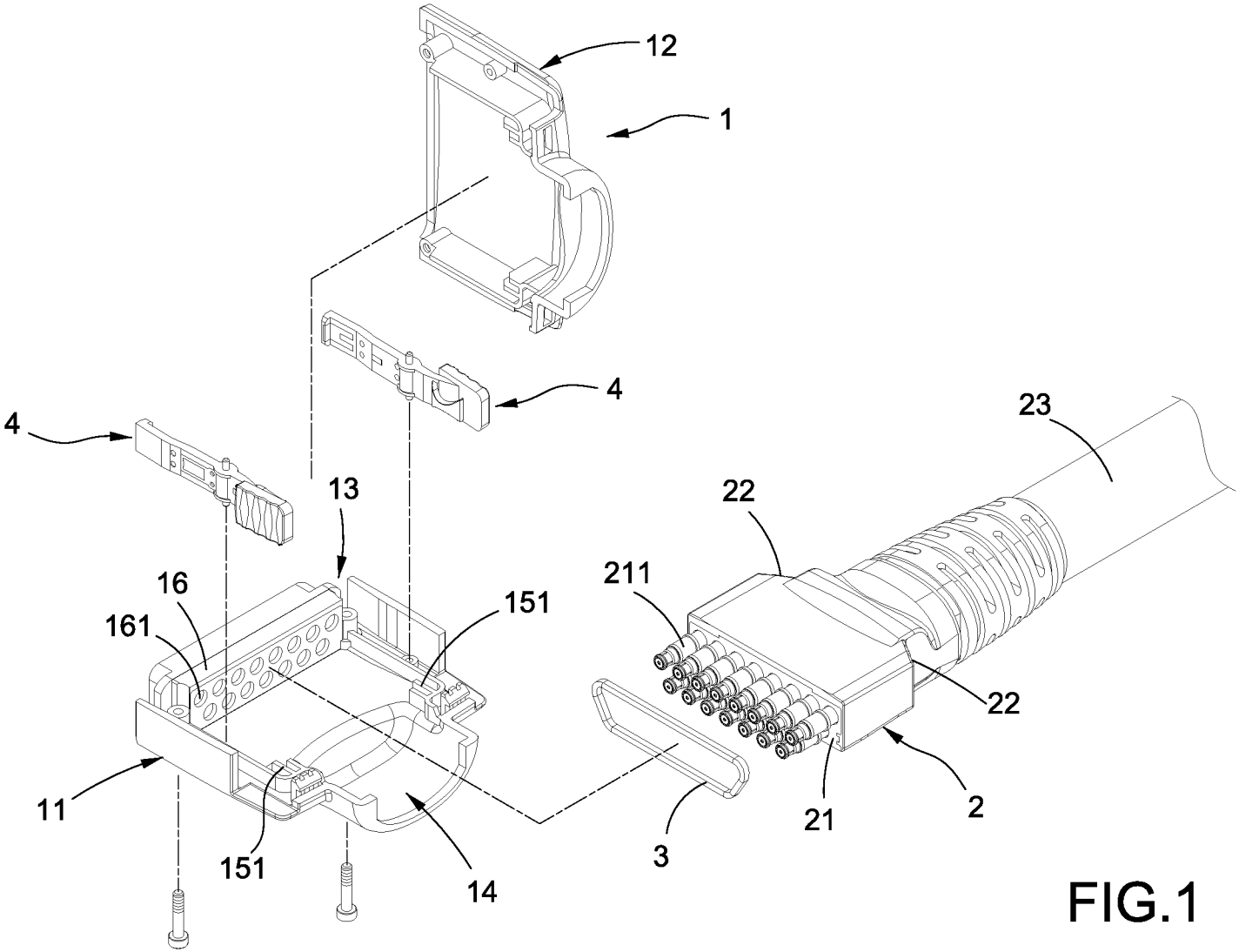
FIG. 1 is a perspective exploded view of the RF connector of the present invention.
Figure 2:
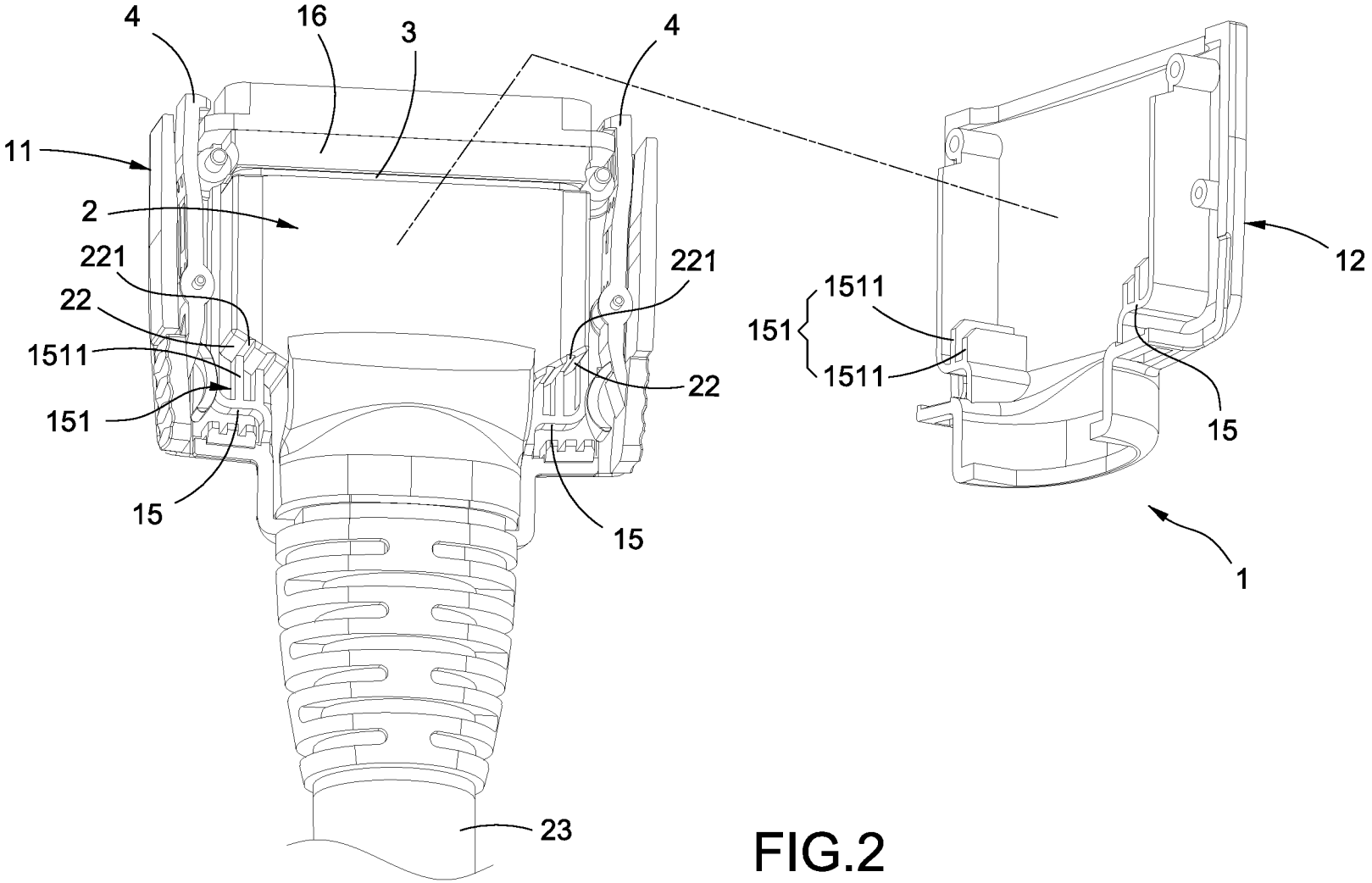
FIG. 2 is a perspective assembly view of the RF connector of the present invention, wherein the second housing is disassembled.
Figure 3:
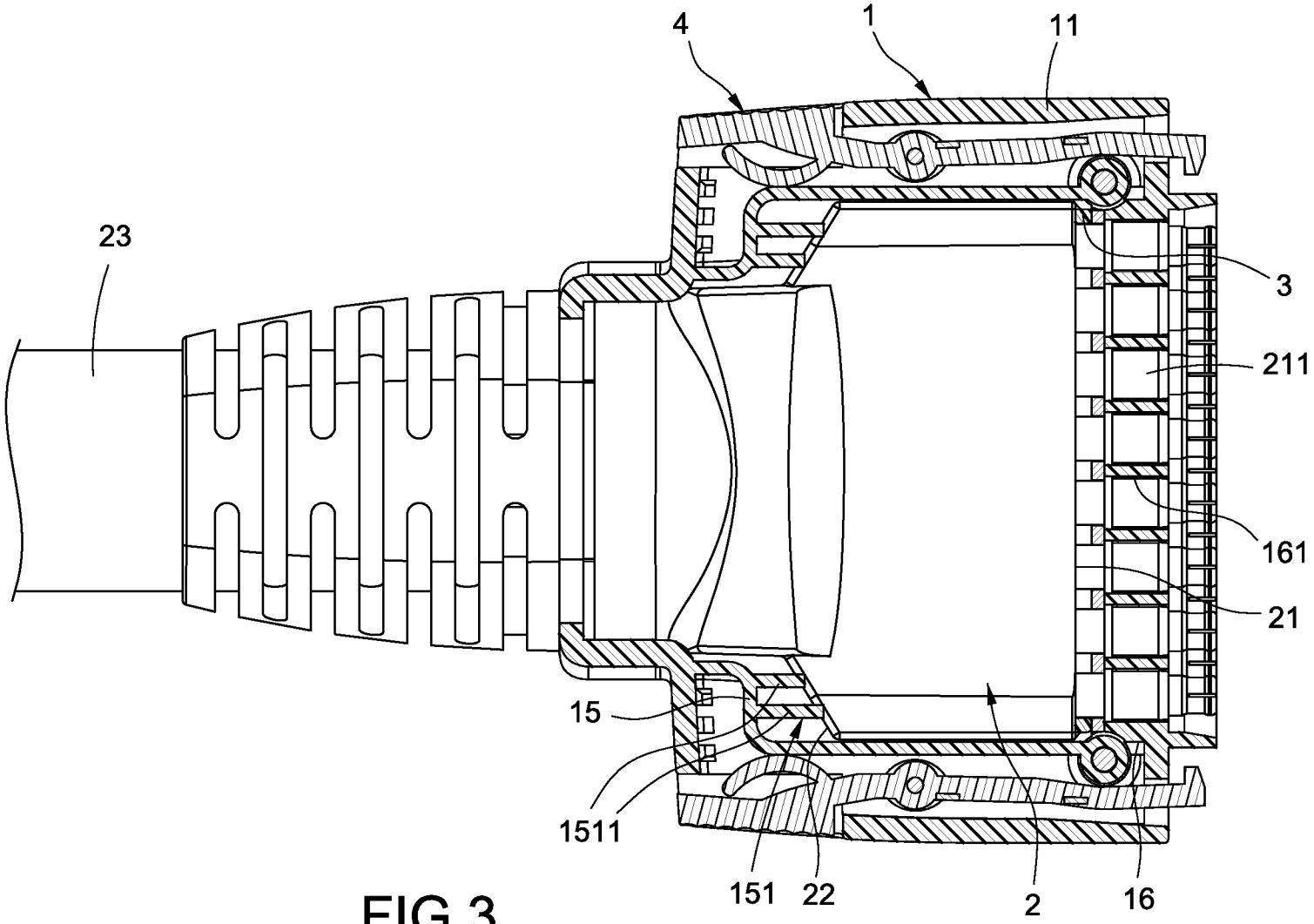
FIG. 3 is a cross sectional schematic view in a transverse direction of the RF connector of the present invention after assembling.

As shown in FIG. 1 to FIG. 3, the present invention provides a waterproof enhanced radio frequency connector including an outer shell 1, a connector 2 and a waterproof gasket 3; specifically, it further includes a pair of clamp arms 4.

The outer shell 1 may be a single-piece structure (not shown in the figure) or a two-piece structure (as shown in the figures), and the present invention does not limit thereto. The outer shell 1 has a first position and a second position opposite to each other (not numbered). The first position has an opening 13, and a necking portion 14 is provided at the non-second position.

The outer shell 1 is provided with a partition wall 16 at the first position, so that the opening 13 is covered with the partition wall 16, and the partition wall 16 has a plurality of through holes 161. The outer shell 1 also has two shoulders 15 located at both sides of the necking portion 14, and the locations of two shoulders 15 are the second position. The two shoulders 15 have at least one convex structure 151 protruding toward the partition wall 16 separately. In addition, the left and right sides of the outer shell 1 are provided with two clamp arms 4.

The connector 2 has a first side 21 and a second side 22 opposite to each other. The first side 21 protrudes with a plurality of plug terminals 211, and the second side 22 is connected with a plurality of signal lines (not shown in the figure). Each signal line is electrically connected with each plug terminal 211 inside the connector 2, and each signal line is combined with the connector 2 to form a signal line group 23 outside thereof.

Figure 4:
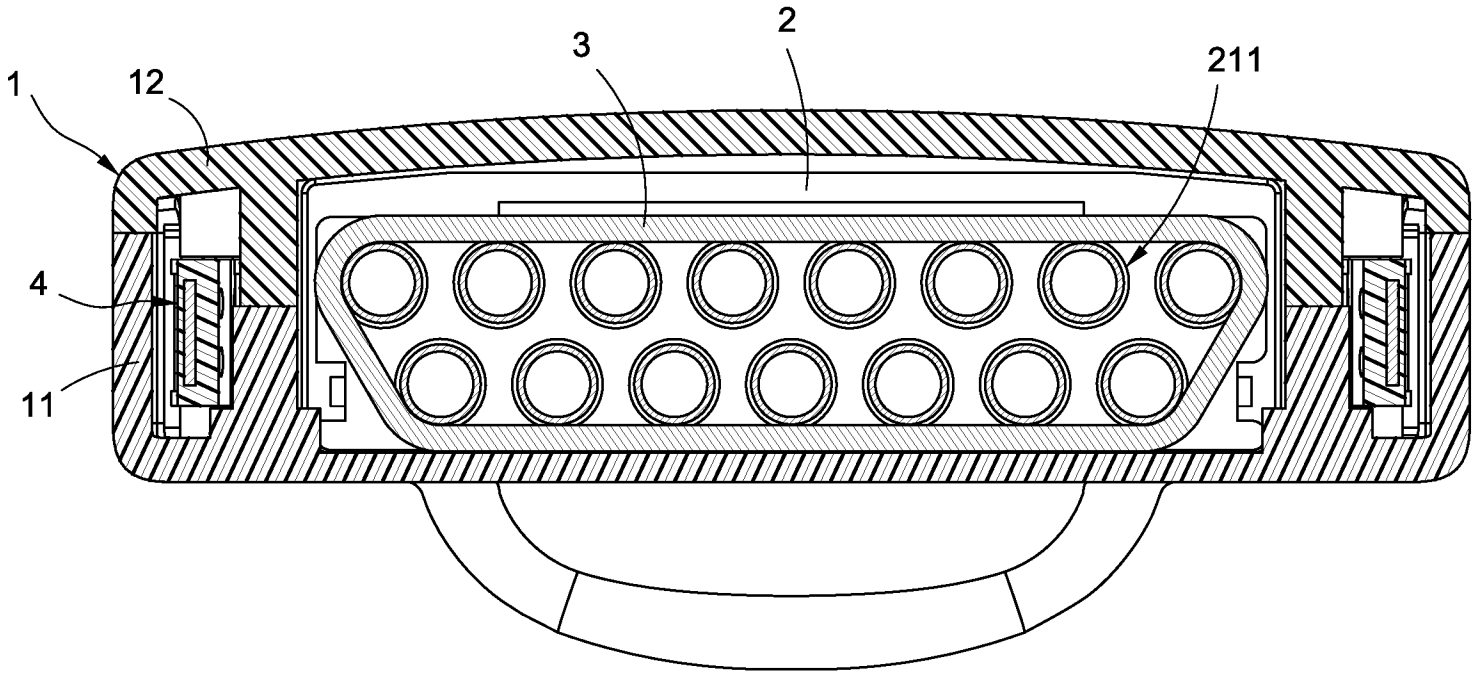
FIG. 4 is a cross sectional schematic view in a longitudinal direction of the RF connector of the present invention after assembling.

The waterproof gasket 3 is disposed surrounding an outer periphery of each plug terminal 211 (or the waterproof gasket 3 is bounded around an outer periphery of all the plug terminals 211 as shown in FIG. 4).

Figure 5:
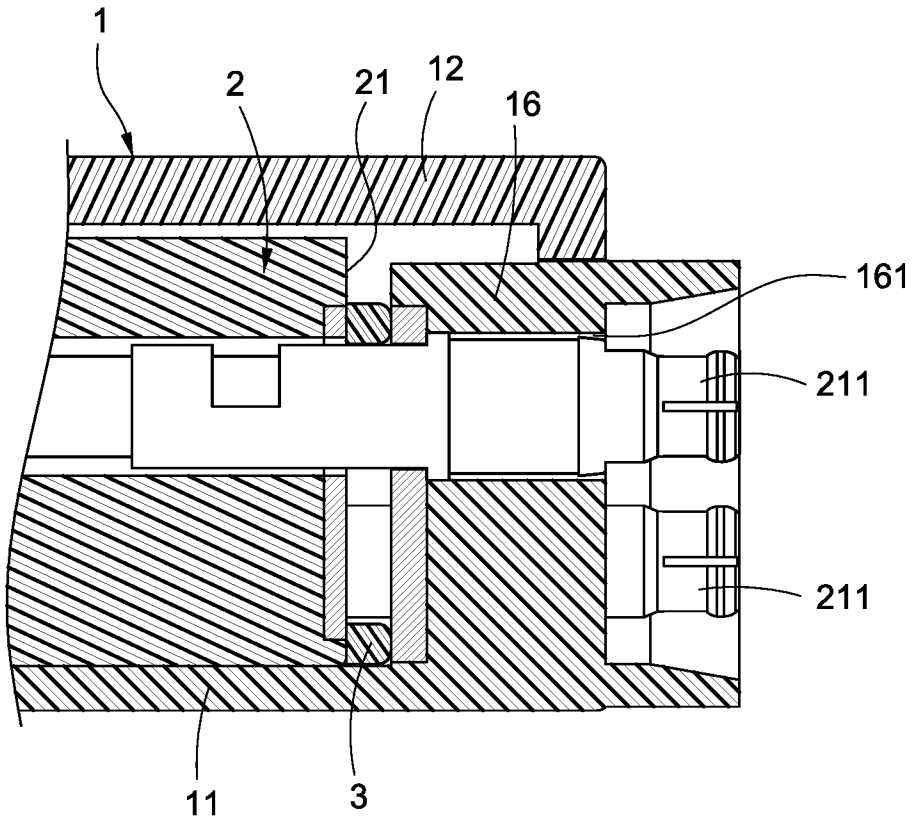
FIG. 5 is a partial cross-sectional schematic view of the RF connector of the present invention after assembling.

As shown in FIG. 3 to FIG. 5, when the connector 2 is accommodated in the outer shell 1 by a user, each plug terminal 211 is received in each through hole 161. Each convex structure 151 abuts the second side 22 of the connector 2, so that the convex structure 151 pushes the connector 2 toward the partition wall 16 to reduce the distance between the first side 21 of the connector 2 and the partition wall 16. Thus, the waterproof gasket 3 can be tightly clamped and sandwiched between the first side 21 and the partition wall 16 to enhance the waterproof effect. At this time, as shown in FIG. 4, the waterproof gasket 3 surrounds both the outer periphery of each plug terminal 211 and all the through holes 161.

It is worth noting that, since the second side 22 of the connector 2 is not necessarily a straight edge, the second side 22 of the connector 2 may be a pair of symmetrical hypotenuses as shown in FIG. 2 and FIG. 3, but the present invention does not limit thereto. In order to make the convex structure 151 abut a non-straight edge of the second side 22, each convex structure 151 includes at least two protrusion ribs 1511. In the present embodiment, two protrusion ribs 1511 are taken as an example for description. Each protrusion rib 1511 protrudes toward the partition wall 16 and abuts the non-straight edge of the second side 22. To achieve this purpose, the lengths of two protrusion ribs 1511 of each convex structure 151 must correspond to a contour of the second side 22. That is, two protrusion ribs 1511 have different lengths of protrusion.

As shown in FIG. 2, for increasing the positioning effect between the protrusion ribs 1511 and the second side 22, the present invention can also provide a positioning groove 221 corresponding to each protrusion rib 1511 at the second side 22, so that an end of each protrusion rib 1511 can be snapped into each positioning groove 211. Therefore, each protrusion rib 1511 has an effect of stable positioning.

As shown in FIG. 1 to FIG. 5, the outer shell 1 includes a first housing 11 and a second housing 12 that can be combined with each other. The aforementioned opening 13, necking portion 14, two shoulders 15 and the convex structure 151 are all formed in half in the first housing 11 and the second housing 12 separately, and only the partition wall 16 is entirely formed in the first housing 11.

In summary, the waterproof enhanced RF connector of the present invention can achieve the intended use and solve the lack of existing technology, which fully meets the requirements of the patent application. The present invention is applied per Patent Law. Please research and grant the present invention to protect the right of the inventor.

Although the present invention has been described with reference to the preferred embodiment thereof, it will be understood that the invention is not limited to the details thereof. Various substitutions and improvements have been suggested in the foregoing description, and others will occur to those of ordinary skill in the art. Therefore, all such substitutions and improvements are intended to be embraced within the scope of the invention as defined in the appended claims.

What is claimed is:

1. A waterproof enhanced radio frequency connector, comprising:

an outer shell having a first position and a second position opposite to each other inside thereof; a partition wall provided at the first position; and the partition wall having a plurality of through holes, and the second position having a plurality of convex structures protruding toward the partition wall;

a connector having a first side and a second side opposite to each other, and the first side protruding with a plurality of plug terminals; and a waterproof gasket disposed surrounding the plug terminals;

wherein, the connector is accommodated in the outer shell, and each of the plug terminals is received in each of the through holes; and the convex structures abut the second side, and the waterproof gasket is clamped and sandwiched between the first side and the partition wall by the convex structures to push the connector toward the partition wall.

2. The waterproof enhanced radio frequency connector according to claim 1, wherein each of the convex structures includes at least two protrusion ribs, and each of the protrusion ribs protrudes toward the partition wall and abuts the second side.

3. The waterproof enhanced radio frequency connector according to claim 2, wherein lengths of protrusion of the at least two protrusion ribs of each convex structure correspond to a contour of the second side.

4. The waterproof enhanced radio frequency connector according to claim 2, wherein the second side is provided with a positioning groove corresponding to each of the protrusion ribs, and an end of each protrusion rib is snapped into each positioning groove.

5. The waterproof enhanced radio frequency connector according to claim 1, wherein the waterproof gasket is also disposed surrounding the through holes.

6. The waterproof enhanced radio frequency connector according to claim 1, wherein the outer shell has a necking portion and two shoulders located at both sides of the necking portion, and locations of the two shoulders are the second position.

7. The waterproof enhanced radio frequency connector according to claim 1, wherein the outer shell includes a first housing and a second housing that are combined with each other.

8. The waterproof enhanced radio frequency connector according to claim 1, wherein the second side of the connector is connected with a plurality of signal lines, and each of the signal lines is electrically connected with each of the plug terminal.

* * * * *